US006238260B1

(12) United States Patent
Spindell

(10) Patent No.: US 6,238,260 B1
(45) Date of Patent: May 29, 2001

(54) EGG HOLDER TOY

(76) Inventor: Adam K. Spindell, 328 Edith Dr., West St. Paul, MN (US) 55118

( * ) Notice: Subject to any disclaimer, the term of this patent is extended or adjusted under 35 U.S.C. 154(b) by 0 days.

(21) Appl. No.: 09/285,291

(22) Filed: Apr. 2, 1999

(51) Int. Cl.[7] ..... A63H 3/00; A47F 7/00

(52) U.S. Cl. ..... 446/72; 446/73; 446/100; 446/386; 446/390; 211/14

(58) Field of Search ..... 446/72, 73, 76, 446/98, 100, 268, 386, 390, 391; 211/14

(56) References Cited

U.S. PATENT DOCUMENTS

| | | | | |
|---|---|---|---|---|
| D. 403,031 | | 12/1998 | Stousland et al. . | |
| 1,631,205 | * | 7/1927 | Horner et al. . | |
| 2,109,965 | * | 3/1938 | Booth . | |
| 2,144,751 | * | 1/1939 | Brown . | |
| 2,424,538 | * | 7/1947 | Beder . | |
| 2,752,730 | * | 7/1956 | Bellett et al. . | |
| 3,590,516 | * | 7/1971 | Dunn . | |
| 3,713,528 | * | 1/1973 | Daenen et al. | 446/73 |
| 3,837,111 | * | 9/1974 | Godfrey et al. . | |
| 4,576,583 | | 3/1986 | Yoneda . | |
| 4,599,235 | * | 7/1986 | Miller et al. | 446/386 |
| 4,757,626 | | 7/1988 | Weinreich . | |
| 5,078,641 | * | 1/1992 | Chen | 446/86 |
| 5,127,652 | | 7/1992 | Unger . | |
| 5,232,390 | * | 8/1993 | Brooks | 446/72 |
| 5,454,746 | * | 10/1995 | Guegan et al. | 446/72 |
| 5,545,069 | * | 8/1996 | Glynn et al. | 446/73 |
| 5,632,377 | * | 5/1997 | Ferrero | 446/73 |
| 5,779,059 | * | 7/1998 | Kotch | 211/14 |

* cited by examiner

*Primary Examiner*—Jacob K. Ackun, Jr.
*Assistant Examiner*—Jeffrey D. Carlson
(74) *Attorney, Agent, or Firm*—Nikolai, Mersereau & Dietz, P.A.

(57) ABSTRACT

An egg holder toy for containing and supporting an egg and depicting with the egg a character of interest includes a support base or a pedestal that includes the lower body and feet of said character of interest and having an open hollow upper recess for receiving a first end of an egg nested therein and a pair of forelimbs of the character attached to the support base and an upper member that includes features of the top of the character of interest selected from the group including hats and upper head features, the upper member having an open hollow lower recess for receiving a second end of said egg.

21 Claims, 4 Drawing Sheets

EGG HOLDER TOY

BACKGROUND OF THE INVENTION

I. Field of the Invention

The present invention relates generally to the field of toy ball or egg holding devices usable with natural (preferably hard boiled) or artificial eggs such as plastic eggs and other small balls. The toys have a lower holder element designed to receive and support one end of the egg or ball in a holder in a nested and unattached relation and include an upper position adopted to be received on top of the egg or ball. The combination of the upper and lower elements with an egg or ball in the middle represent human or animal characters of interest. The character may include decals placeable on the egg or ball to further represent the facial or other characteristics of the head of the character of interest.

II. Related Art

Toy caricatures having human or animal features are well known. Such caricatures have also been used, for example, in the form of toy caricatures using sports equipment such as footballs, basketballs, or the like. Such a sport caricature system with attached, removable ball appendages is depicted in U.S. Design Patent DES 403031 issued to Stousland et al. The direct attachment of the arm and leg appendages, however, make such a concept difficult to use with delicate structures such as natural eggs.

The present invention contemplates an amusement device or toy, but also a useful independent support for carrying eggs such as real or artificial Easter eggs nested therein in which the eggs are retained but are unattached to the support. The supports or holders of the invention may be generally crafted to depict any animal or human likeness and the characters may include decals removably applicable to carried egg or small ball or even permanent decal features.

Accordingly, it is a primary object of the present invention to provide amusement devices in the form of animal or human character likenesses associated with small balls or natural or artificial eggs, including Easter eggs, that can be used to support or carry the eggs.

Another object of the invention is to provide such amusement devices that also provide useful support for small balls or natural or artificial eggs, including Easter eggs that receive and carry but are not attached to the balls or Easter eggs involved.

Yet another object of the present invention is to provide such a useful support in the form of a caricature or character of interest resembling an animal or a human likeness in which the egg forms the head of the likeness.

Yet still another object of the present invention is to provide removable decals applicable to the small ball or natural or artificial eggs to enhance the characterization of facial and other head features of the character of interest.

Other objects and advantages of the present invention will become apparent from familiarization with the specification, drawings and claims found in this application.

SUMMARY OF THE INVENTION

The present invention provides a toy or amusement device in conjunction with a support holder for carrying natural and artificial eggs of all kinds, particularly of the chicken egg size, and small balls. One preferred embodiment of the device includes a support base in the form of a pedestal that includes the lower body and feet of human or animal character of interest and also contains an open hollow upper recess for receiving one end of an egg or other egg-shaped object or a small ball therein. Also attached to the support base are a pair of forelimbs or arms spaced from the support base by an integral intermediate stem member, the arms or forelimbs being those of the character of the support base. This base is normally used in conjunction with a separator upper member that includes features of the top of the character of interest and is selected from hats and other upper head feature structures such as rabbit ears, hairdos antennae, wreaths, crowns and halos. The upper member also has an open hollow lower recess for receiving the upper end of the egg or ball or other object being contained in the toy holder support base. In this manner, the holder toy acts as a delicate holder in which arms or forelegs serve to retain the egg in the holder and the lower torso or pedestal containing the feet provides a recessed seat for the egg, or the like. A hat or upper member fits down over the egg to also help stabilize it in its holder.

No adhesive or other material or holding device need be utilized in conjunction with retaining the egg in the holder device. In this manner, the egg holder toy is contemplated to be an arts and crafts type or creative toy in which users of the toy can also create their own characters using a variety of interchangeable top and bottom elements to make up the egg holder such and by decorating, dyeing and/or drawing original faces on the egg and placing the decorated egg in the holder to create a new character using such a combination of basic upper and lower elements. It is also contemplated that decals can be provided for the purpose of decorating the face and other head features of the character of interest. These devices may be removable as by providing them with any of several temporary, reusable adhesive which enable the decals to be pealed off and reapplied. Such materials are well known to those skilled in the art and are readily available commercially. The decals, in any event, do not interfere with other uses for the egg.

While the primary use of the egg holder toy of the invention may be to contain hard boiled decorated Easter eggs, it is further contemplated that drained, decorated eggs such as those traditionally associated with Ukrainian Easter, uncooked eggs, artificial or plastic egg shapes and small balls could be utilized in the same manner. It is also part of the invention to provide such a toy egg holding system in which the upper and lower members, together with the forelimbs or arms are joined in one continuous structure which can be opened to receive the egg within upper and lower recesses, which will resiliently regain its original shape capturing and containing the egg therein.

As used herein, the term "egg" refers to any natural or artificial egg or any small egg-shaped object including hard or soft plastic or foam egg shapes and small balls or other elements compatible with the concept of the invention as would occur to those skilled in the art. While certain examples are given in the detailed description, it is contemplated that any imaginable character of interest could be produced in the form contemplated for the invention and those actually depicted are merely intended as illustrative embodiments or arrangements.

BRIEF DESCRIPTION OF THE DRAWINGS

In the drawings, wherein like numerals depict like parts throughout the same.

DETAILED DESCRIPTION

While the detailed embodiments illustrate the invention with particular regard to toy holders for eggs, it will be appreciated that any egg-shaped object or comparable sized ball can be used in accordance with the device of the invention. The toy egg holder may take any one of several forms of construction, each being characterized by surrounding but not being fixed to the egg or other object contained therein. Each holder is designed to depict a character or character-type of interest utilizing the egg or other object as an integral part of the character. Facial features may be applied to the egg surface in any desired manner including by paint, crayon, marker, decal, etc. applied to the shell or outer surface. In this manner, the following detailed embodiments are presented by way of example and not limitation.

Figure 1D:
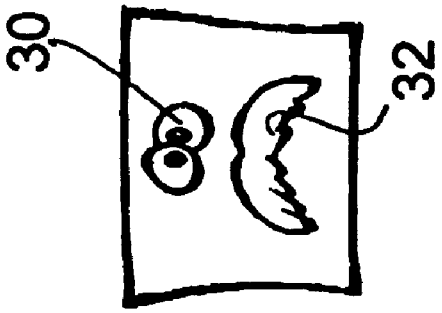
FIG. 1D depicts one possible set of facial decals for use with one or more embodiments of the invention.
Figure 1C:
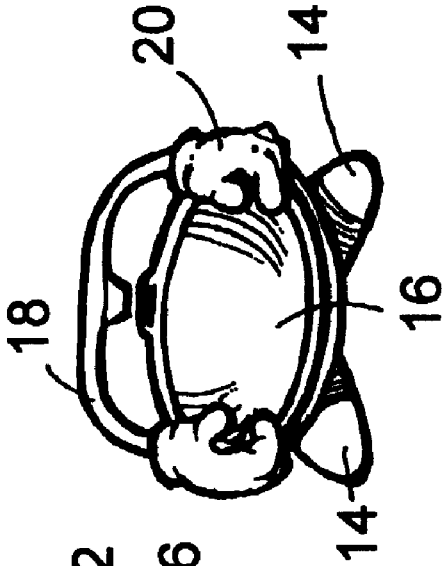
FIGS. 1A–1C depict, in blown apart or exploded arrangement, one embodiment of an egg holder in accordance with the invention.
Figure 1B:
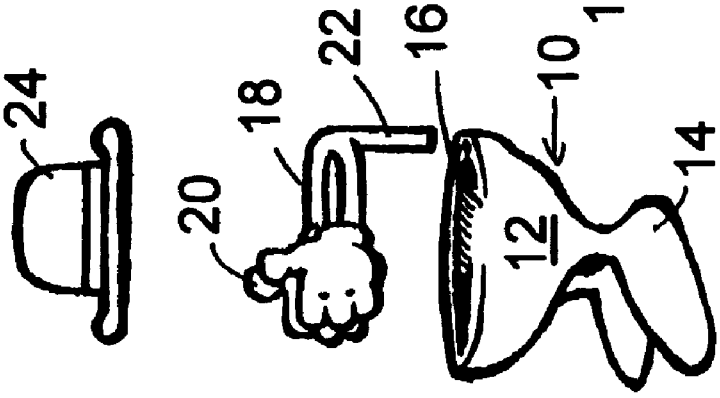
Figure 1A:
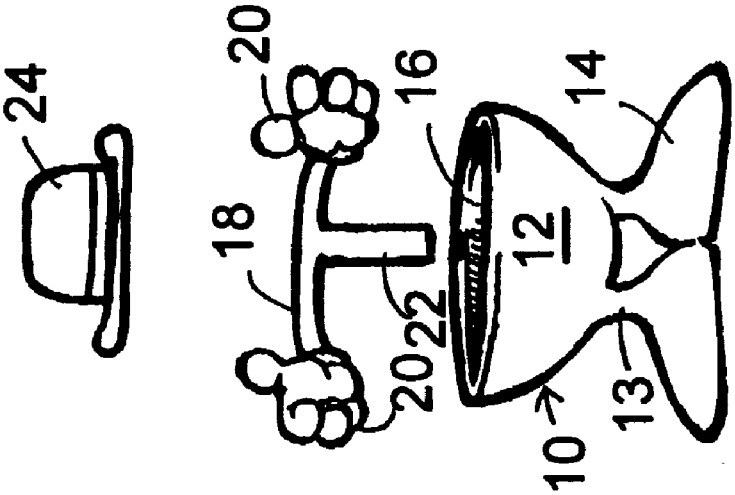
Figure 2A:
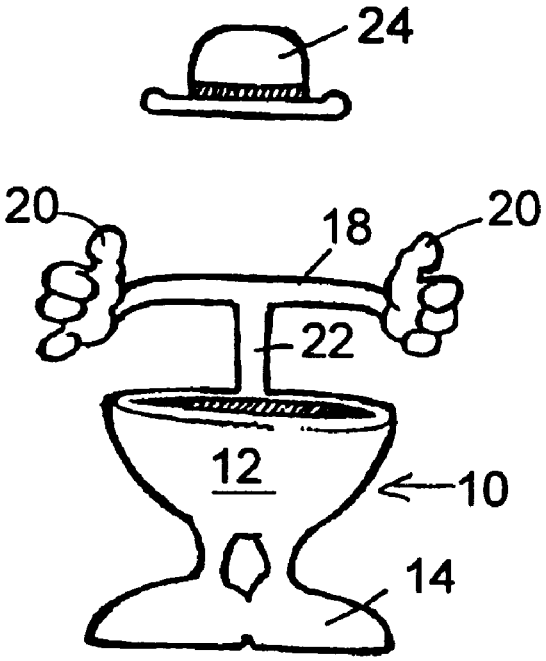
FIGS. 2A and 2B depict an alternative embodiment of the egg holder of the invention.
Figure 2B:
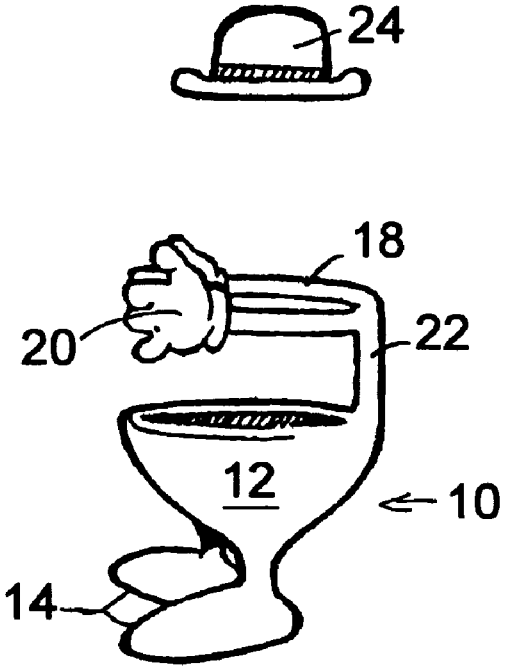

FIGS. 1A–1C illustrate in blown apart or exploded view one form of the egg holder toy of the invention in which a support base or pedestal 10 represents the lower body or torso 12, legs 13 and feet 14 of a character and includes an open hollow upper recess configured to receive one end of an egg or similar rounded object, not shown, nested therein. A pair of arms 18 with hands 20 connected together at a stem 22 is itself designed to be removably received in a recess 22 in support base 10. The arms 18 with hands 20 are configured to partially surround and help retain the upper portion of the contained egg or other object, one end of which is placed in the recess 16. The arms 18 preferably are made of a material that is resilient so they can be spread apart to accommodate objects of different sizes and thereafter will return to a retaining posture when released. A hat or fedora 24 or other prop structure is provided to rest on the upper end of the egg. The hat 24 is also provided with a downward directed internal recess similar to the recess 16 to accommodate the upper end of the egg or contained object. FIG. 1D depicts possible peel-off facial decals for eyes 30 and a mustache 32 which can be applied to a held egg or the like to complete with the above-support base and integral arm system a complete character of interest.

Figure 4B:
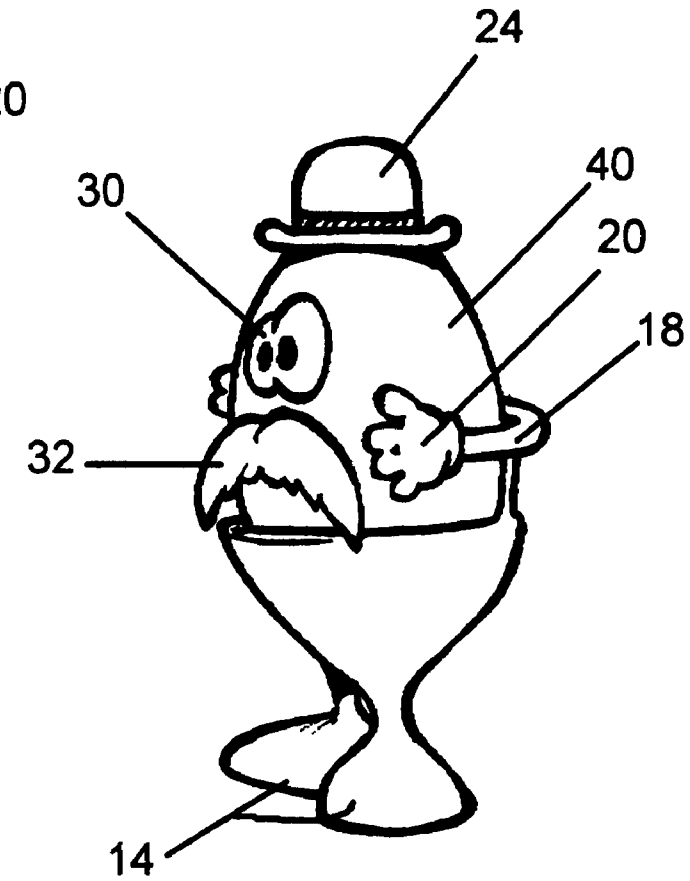
FIGS. 4A and 4B illustrate an assembly of the invention with an egg or similar object placed in the holder.
Figure 4A:
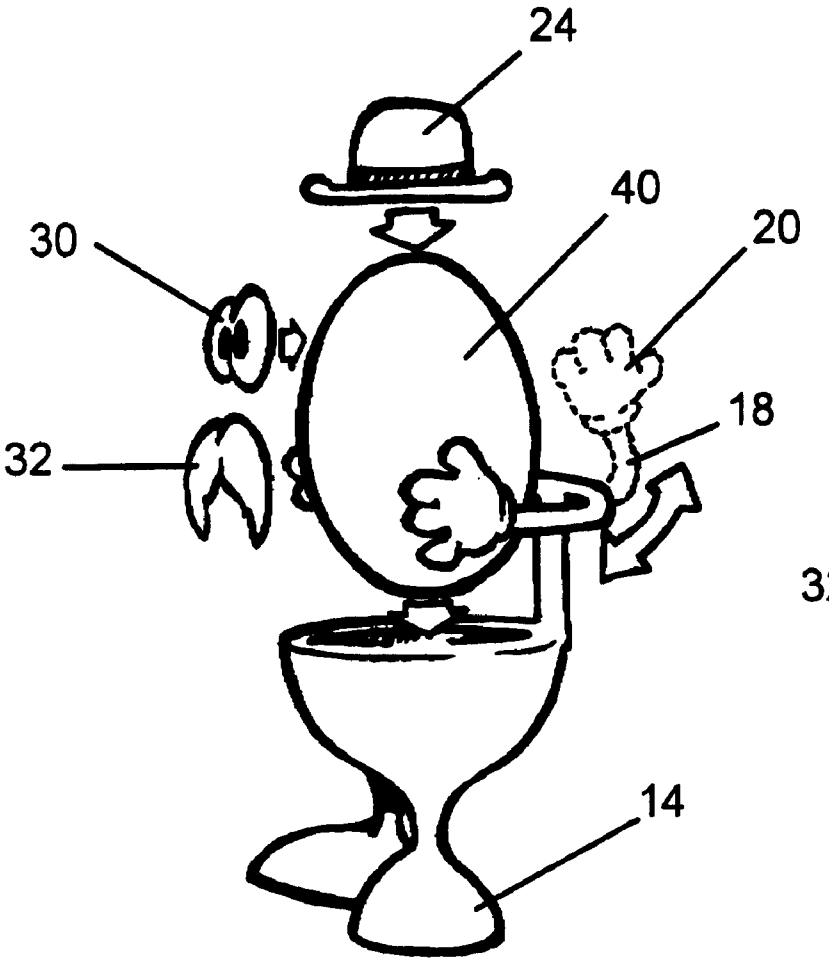
Figure 5A:
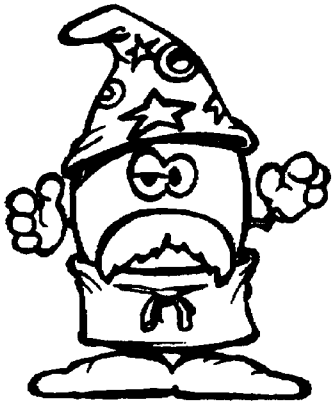
FIGS. 5A–5G illustrate a variety of additional embodiments of the invention.
Figure 5B:
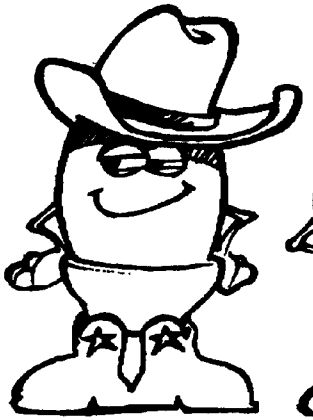
Figure 5C:
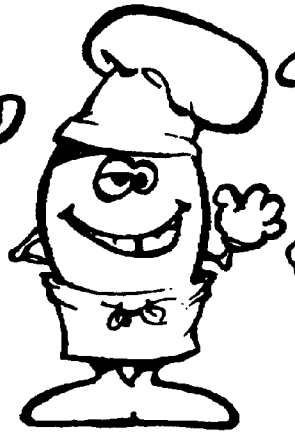
Figure 5D:
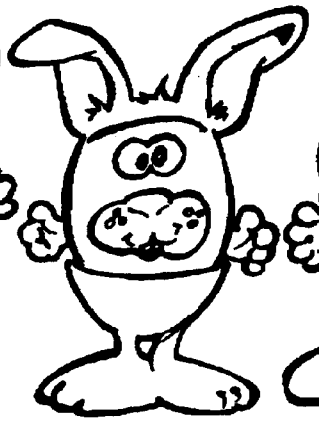
Figure 5E:
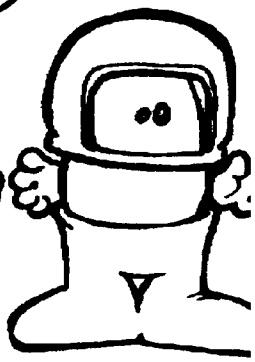
Figure 5F:
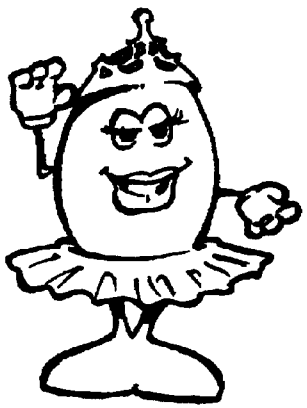
Figure 5G:
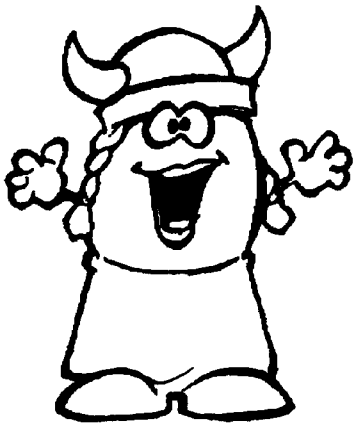

The assembly of such a toy device is depicted in greater detail in FIGS. 4A and 4B using an egg 40 in the assembly. As can be seen from those figures, the arm 18, which is preferably made of a material that is resilient, as explained above, with hand 20 can be moved out of the way so that the egg 40 may be placed in the recess 16 and the hat 24 thereafter placed on top. Decals 30 and 32 can be placed on the egg to complete the facial features.

Using the same general character illustration as that of FIGS. 1A–1D and FIGS. 4A and 4B, FIGS. 2A and 2B illustrate an alternative embodiment in which the stem 22 is produced as an integral part of the support base or pedestal 10, making this unit including the arms a unitary construction.

Figure 3A:
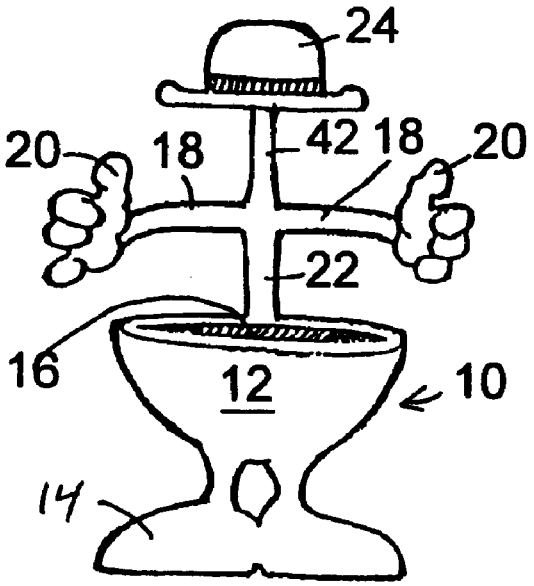
FIGS. 3A and 3B depict yet another embodiment of the egg holder of the invention.
Figure 3B:
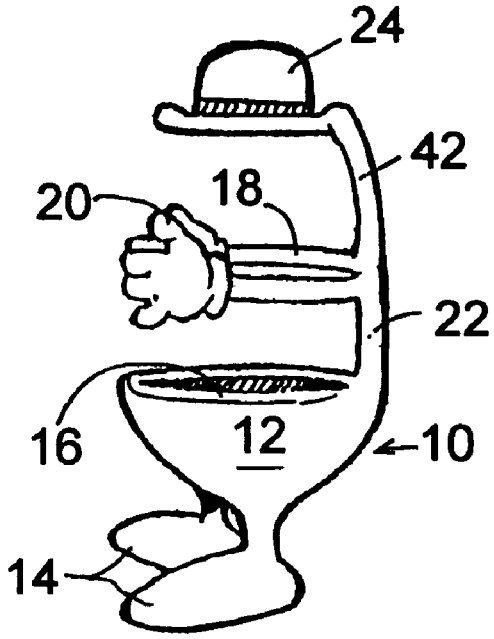

FIGS. 3A and 3B illustrate yet another embodiment in which the upper member or hat 24 is also integrally connected with the stem 22 utilizing an additional integral stem member 42. In this embodiment, the entire holder is of a one piece construction in which optional facial features may be added.

The FIGS. 5A–5G illustrate a variety of other characters which further illustrate the versatility of the egg holder toy with respect to the variety of characters that can be represented. Thus, using minor variations on this theme, the number of possible character representations is almost inexhaustible and can, of course, utilize animal representations as with the rabbit of FIG. 5D. As noted in those figures, the base members and top members can take a large variety of forms so long as they provide a stable base recess to contain the egg or other object of interest.

This invention has been described herein in considerable detail in order to comply with the patent statutes and to provide those skilled in the art with the information needed to apply the novel principles and to construct and use such specialized components as are required. However, it is to he understood that the invention can be carried out by specifically different devices, and that various modifications, both as to the equipment details and operating procedures, can be accomplished without departing from the scope of the invention itself.

What is claimed is:

1. A holder toy containing and supporting a round or egg-shaped object having a convex surface and with that object depicting a character of interest, comprising:

(a) a round or egg-shaped object;

(b) a support base having a pedestal that includes a lower body and hind feet, and a pair of forelimbs of said character attached to the support base of said character of interest and having an open hollow upward-directed recess receiving one part of a convex surface of said object nested therein; and (c) an upper member that includes features of the top of a character of interest selected from the group including hats and upper head features, said upper member having an open hollow downward-facing recess receiving a second portion of said convex surface of said object nested in said support base;

(d) wherein a central portion of said object nested in said support base and received in said upper member remains as an exposed portion therebetween.

2. The device of claim 1 further comprising facial feature decals for application to said exposed portion of said object nested in said support base and received in said downward-facing recess to further depict the character of interest.

3. The device of claim 2 wherein the decals are removable.

4. The device of claim 1 wherein the character of interest is an animal likeness.

5. The device of claim 2 wherein the character of interest is an animal likeness.

6. The device of claim 1 wherein the character of interest represents a human likeness.

7. The device of claim 2 wherein the character of interest represent a human likeness.

8. The device of claim 1 wherein said forelimbs are removably attached to said support base.

9. The device of claim 1 wherein said support base and said upper member are part of a unitary structure.

10. An egg holder toy containing and supporting an egg and depicting with the egg a character of interest comprising:

(a) an egg;

(b) a support base having a pedestal that includes a lower body and feet, and a pair of forelimbs above the lower body attached to said support base of said character of interest, said support base having an open hollow upward-facing recess receiving a first end of said egg nested therein; and (c) an upper member that includes features of the top of the character of interest selected from the group including hats and upper head features, said upper member having an open hollow downward-facing recess receiving a second end of said egg;

(d) wherein a central portion of said egg nested in said support base and received in said upper member remains as an exposed portion therebetween.

11. The device of claim 10 further comprising facial feature decals for attachment to said exposed portion of said egg for further depicting the character of interest.

12. The device of claim 11 wherein the decals are removable.

13. The device of claim 10 wherein the character of interest is an animal likeness.

14. The device of claim 11 wherein the character of interest is an animal likeness.

15. The device of claim 10 wherein the character of interest represents a human likeness.

16. The device of claim 11 wherein the character of interest represents a human likeness.

17. The device of claim 10 wherein said support base and said upper member are part of a unitary structure.

18. The device of claim 10 wherein said forelimbs are removably attached to said support base.

19. The device of claim 10 wherein said egg is selected from eggs made of artificial materials.

20. The device of claim 10 wherein said egg is selected from the group including raw, hard boiled and drained eggs.

21. A holder toy containing and supporting a round or egg-shaped object having a convex surface and with that object depicting a character of interest, comprising:

(a) a round or egg-shaped object;

(b) a support base having a pedestal that includes a lower body and hind feet, and a pair of forelimbs of said character attached to the support base of said character of interest and having an open hollow upward-directed recess including said round or egg-shaped object having a convex surface nested therein; and (c) an upper member that includes features of the top of a character of interest selected from the group including hats and upper head features, said upper member having an open hollow downward-facing recess receiving a second portion of said convex surface of said object;

(d) wherein a central portion of said object nested in said support base and received in said upper member remains as an exposed portion therebetween; and (e) wherein said support base and said upper member are part of a unitary structure.

* * * * *